US007090010B1

(12) United States Patent
Martin

(10) Patent No.: US 7,090,010 B1
(45) Date of Patent: Aug. 15, 2006

(54) GAUGE CARRIER SUB APPARATUS

(76) Inventor: Todd Martin, 3529 Taxi Road Airport Industrial Park, Houma, LA (US) 70363

( * ) Notice: Subject to any disclaimer, the term of this patent is extended or adjusted under 35 U.S.C. 154(b) by 23 days.

(21) Appl. No.: 10/671,137

(22) Filed: Sep. 25, 2003

(51) Int. Cl.
*E21B 47/01* (2006.01)

(52) U.S. Cl. ..... 166/250.11; 166/169; 166/242.1

(58) Field of Classification Search ..... 166/113, 166/162, 169, 242.1, 250.01, 250.07, 250.11, 166/252.5
See application file for complete search history.

(56) References Cited

U.S. PATENT DOCUMENTS 4,184,545 A 1/1980 Claycomb
4,553,599 A 11/1985 Glotin
4,628,995 A * 12/1986 Young et al. ..... 166/113
4,660,638 A 4/1987 Yates, Jr.
4,687,055 A 8/1987 Leggett
4,932,471 A 6/1990 Tucker et al.
5,320,169 A 6/1994 Delatorre
6,263,730 B1 7/2001 Grande et al.
6,446,736 B1 9/2002 Kruspe et al.
6,655,452 B1 * 12/2003 Zillinger ..... 166/66

* cited by examiner

*Primary Examiner*—Zakiya W. Bates
(74) *Attorney, Agent, or Firm*—Garvey, Smith, Nehrbass & North, L.L.C.; Gregory C. Smith

(57) ABSTRACT

A sub apparatus for delivering and protecting a gauge being lowered down a well bore, which includes a sub body having a first and second ends threadably engageable to sections of pipe in the drill or production string; the sub body including a first chamber for housing the gauge; a second bore through the sub body for allowing fluid flowing within the drill or production string to flow through the sub; a plurality of openings formed in the wall of the sub in fluid communication with the first chamber to allow fluids within the pipe to make fluid contact with the gauge; means for protecting the gauge on a first end and means for engaging the gauge to the sub on a second end.

15 Claims, 2 Drawing Sheets

GAUGE CARRIER SUB APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Technical Field of the Invention

The apparatus of the present invention relates to gauges used down a bore hole. More particularly, the present invention relates to a sub which is designed to carry sensitive gauges, which measure conditions down the bore hole, in order to protect the gauge from damage.

2. General Background of the Invention

In the very complex operation of drilling and completing oil and gas wells, it is critical that the conditions down the bore hole, such as temperature and pressure of the fluid, or of the surrounding earth are constantly monitored in order to avoid problems, such as blowout or other adverse conditions to arise. This monitoring is often down by gauges or other types of instruments which are lowered down the bore hole, either in a cased or uncased holes, in order to monitor and record the conditions of the well bore. One of the problems in such monitoring with gauges are that the gauges, which by their nature, are very sensitive, are subject to harsh conditions down the well bore, and are subject to being damaged or destroyed by foreign objects down the well bore.

Therefore, there is a need for a means for allowing a sensitive gauge, such as the type of gauge manufactured by Spartek, Inc., model 2700, which records various conditions down a well bore, to offer protection for the gauge as it is run down the well bore, yet allows the gauge sufficient access to the interior of the borehole for obtaining accurate readings.

Applicant is submitting herewith an information disclosure statement which includes additional prior art that applicant is aware of at this time.

BRIEF SUMMARY OF THE INVENTION

The present invention solved the problems in the art in a simple and straight forward manner. What is provided is a sub apparatus for carrying a gauge down a well bore, which includes a sub body having a first and second ends threadably engageable to sections of pipe in the drill or production string; the sub body including a first chamber for housing the gauge; a second bore through the sub body for allowing fluid to flow through the sub within the pipe; a plurality of openings in the wall of the sub at points to allow fluids within the pipe to make fluid contact with the gauge; means for protecting the gauge on a first end and for engaging the gauge to the sub on a second end.

Therefore, it is the principal object of the present invention to provide a sub secured within a drill or production string for housing a gauge for obtaining readings down the well bore;

It is a further object of the present invention to provide a sub for a gauge lowered down a well bore for protecting the gauge from harmful contact and yet allowing the gauge to obtain accurate readings down the well bore;

It is a further object of the present invention to provide a sub apparatus having a protective chamber for a gauge within the sub, and allowing fluid in drill or production string to flow through the gauge unimpeded.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENTS

Figure 1:
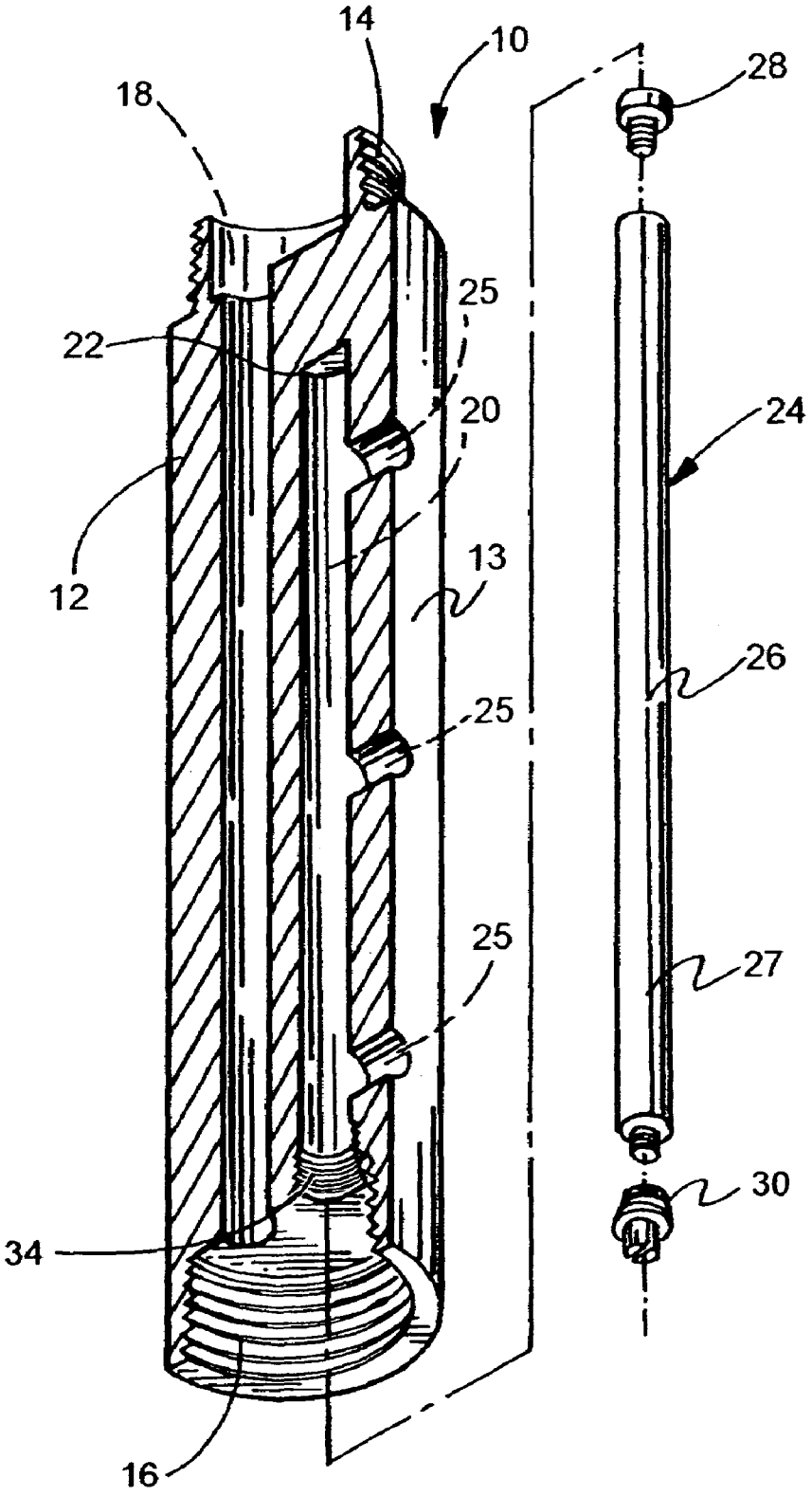
FIG. 1 illustrates an overall cross-section view of the preferred embodiment of the sub apparatus of the present invention with a typical gauge.
Figure 2:
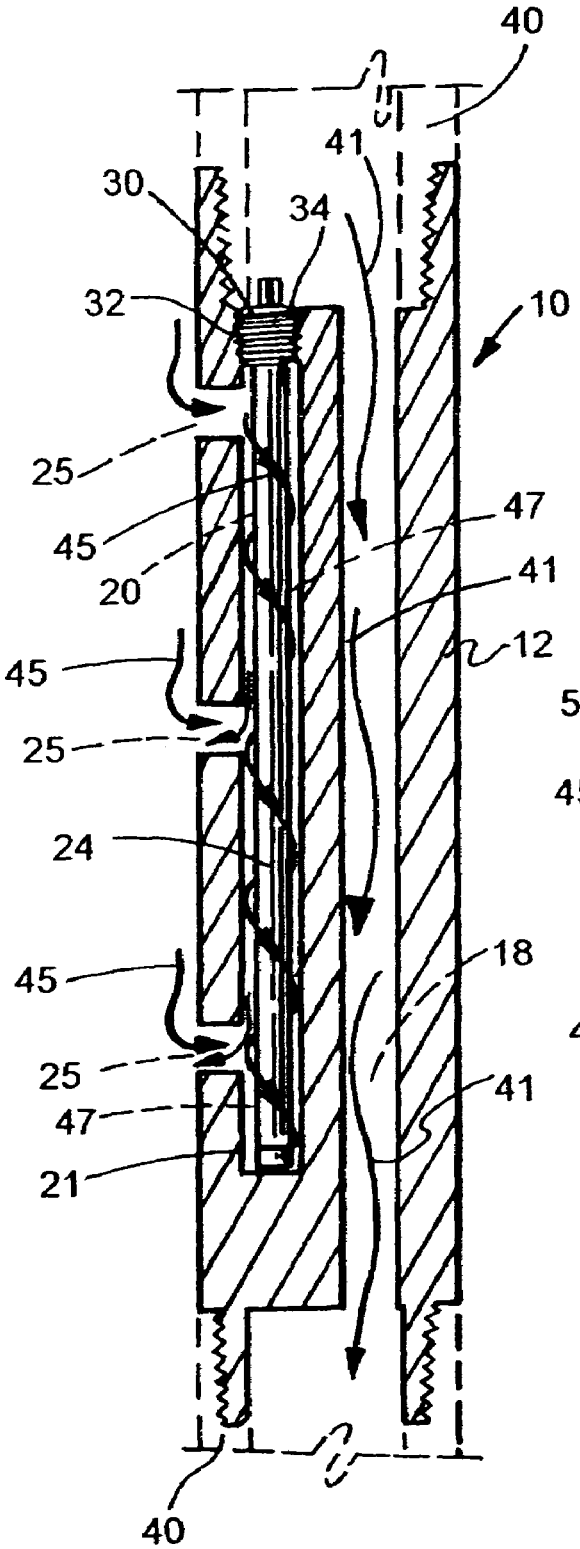
FIG. 2 illustrates a cross sectional view of the protective sub housing a gauge within the sub which the sub is secured along a drill or production string.
Figure 3:
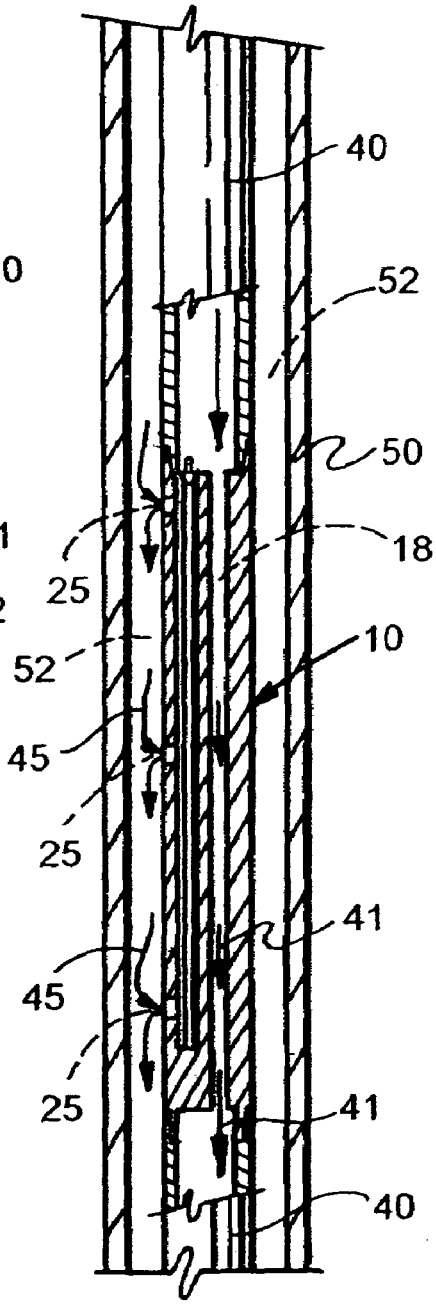
FIG. 3 illustrate an overall view of a protective sub secured along a drill or production string, while the string is being lowered down a well bore.

FIGS. 1 through 3 illustrate the preferred embodiment of the present invention by the numeral 10. As illustrated, the gauge protection sub 10 comprises a generally cylindrical body 12, having a continuous circular sidewall 15, which terminates in a first pin end 14 and a box end 16, the ends 14, 16, threaded in order to be threadably engaged to a length of drill pipe, production pipe or other threaded members in a drill or production string. The body 12 in constructed of a durable material, such as tempered steel or the like so as to withstand contact with foreign objects down a well bore, as the sub 10 is moved down a well bore as part of the drill or production string. The sub body 12 also includes a first bore 18 extending from the pin end 14 through the box end 16, through the entire body 12, so as to allow fluid flow through the bore 18, for the reasons as will be explained further.

The sub body 12 also includes a chamber 20 which would extend from the box end 16 of the sub body 12, to a certain distance within the body 12, and terminate at point 22 within the sub body 12. The chamber 20 would be of a particular, pre-determined length and width as to accommodate a gauge 24, also illustrated in FIG. 1, within the chamber. There is further illustrated a plurality of ports 25 formed in the wall 15 of the sub 10. As seen in FIG. 1, there is illustrated a total of three ports substantially equidistant apart, and each in communication with the chamber 20, for purposes as will be discussed further.

The gauge 24 as illustrated would be a typical type gauge for measuring conditions down a well bore, and would generally have an elongated body 26, having a wall 27, and being of a width so as to be accommodated within the chamber 20. Also illustrated in FIG. 1, the gauge would have a first lower end cap 28 threadably engaged to the gauge body 26, and an upper end cap 30 threaded to the gauge body 26, both for purposes to be discussed further. The gauge may be of any number of types of gauges, which would include a gauge manufactured by Spartek, Inc., model 2700, which records various conditions down a well bore from fluid contact with the wall 27 of the gauge body 26, and records the data received for review when the gauge is returned to the surface.

Turning now to FIGS. 2 and 3, there is illustrated the sub 10 having the gauge 24 housed within the chamber 20. In this figure, the gauge 24, has had the first lower end cap 28 engaged to its lower end and lowered into the protective chamber 20. The end cap 28 is constructed of a protective material, such as Teflon (a registered trademark of Dupont Co.), which would rest on the floor 21 of chamber 20 and absorb any impact between the floor 21 and the gauge body 26. The second end of the gauge has received the upper end cap 30, which as been threaded to the gauge body 26. The cap 28 also has a second set of threads 32 which would thread into the threaded box portion 34 of the upper end of the chamber 20 and secure it in place, so that the lower end cap 28 of the gauge rests on the floor 21 of the chamber 20, and the upper end is securely threaded in place. In this manner the gauge is secure within the chamber 20.

As further illustrated in FIGS. 2 and 3, the sub 10 is secured to a length of for example, drill pipe 40 on its upper end and a length of drill pipe 40 on its lower end, and is part of the drill string being lowered down the well bore. As illustrated in FIG. 2, the three ports 25, which are provided along the three points along the wall 15 of the sub 10, and make fluid contact with the interior of the chamber 18, allow fluid within the well bore to flow through the ports 25, shown by arrows 45, and flow around the wall of the gauge 24, in the annular space 47 within the chamber 20. This fluid flow in and out of the ports 25 as the gauge 24 is contained within the chamber 20 as it moves down the well bore allows the gauge to constantly record the various conditions of the well bore as the particular gauge is designed to record. Although the three ports 25 are spaced equally apart from one another, the ports may be placed anywhere along the wall of the sub 10, as long as the ports fluidly communicate with the chamber 20 so that the gauge 24 may record the well bore conditions. Also, as seen in FIG. 2, the sub 10 includes the flow bore 18 through its body so as to allow any fluid, depicted by arrows 41, which may be flowing through the drill or production pipe 40 to flow through the flow bore 18 in the sub 10, so as not to interrupt fluid flow which the sub 10 is being used in the testing down the well bore.

Turning now to FIG. 3, the sub 10 is again illustrated between sections of pipe 40, and housing the gauge 24 within the chamber 20, and engaged for testing purposes. The only difference is that in FIG. 3, the drill or production string, with the sub 10 engaged thereupon, is being lowered down a casing 50, in a cased well. In this configuration, the gauge 24 would be recording data from conditions within the annular space 52 between the sub 10 and the casing 50, while fluid flows through the sub 10 through bore 18, as seen by arrows 41. In FIG. 2, the sub 10 could be considered being lowered down an uncased bore hole where the gauge 24 within the sub 10 is recording conditions down within the uncased bore hole.

For purposes of construction, the sub 20 would be of variable lengths and widths depending on the size of the drill or production or other type of pipe upon which it is carried. Likewise the sub 20 would have thread sizes to accommodate a variety of threaded members. The length of the chamber 20 would be determined by the type and size of gauge 24 that would be utilized. And, as stated earlier, the location of the ports 25 in the wall of the sub body 12 could be of varying numbers and position so long as the ports allowed sufficient access of fluid into the chamber 20 to make contact with the gauge 24 so that proper data could be obtained down the well bore.

PARTS LIST

The following is a list of parts and materials suitable for use in the present invention:

| Description | Part No. |
|---|---|
| Gauge Protection Sub | 10 |
| Body | 12 |
| First Pin end | 14 |
| Sidewall | 15 |
| Box end | 16 |
| First | 18 |
| Chamber | 20 |
| Floor | 21 |
| Point | 22 |
| Gauge | 24 |
| Ports | 25 |
| Elongated body | 26 |
| Wall | 27 |
| Lower end cap | 28 |
| Upper end cap | 30 |
| Threads | 32 |
| Box portion | 34 |
| Drill pipe | 40 |
| Arrows | 41 |
| Arrows | 45 |
| Annular space | 47 |
| Casing | 50 |
| Annular space | 52 |

The foregoing embodiments are presented by way of example only; the scope of the present invention is to be limited only by the following claims.

What is claimed is:

1. A sub for delivering a gauge down a well bore, comprising:

a. a sub body, having first and second ends attachable to sections of pipe;

b. a first flow bore through the sub body for allowing fluid within the sections of pipe to flow through the sub body;

c. a chamber formed in the sub body, which has no fluid contact with the flow bore in the sub body;

d. a gauge receivable into the chamber and secured therein; and e. at least one port in the wall of the sub body in fluid communication with the chamber to allow fluid around the sub body to flow in and out of the chamber so that fluid conditions can be recorded by the gauge.

2. The sub apparatus in claim 1, further comprising a flow bore through the sub body for allowing fluid within the pipe to flow through the sub body.

3. The sub apparatus in claim 1, wherein the gauge is threadably secured into the chamber.

4. The sub apparatus in claim 1, wherein the gauge rests on a floor of the chamber when the gauge has been threadably secured in the chamber.

5. The sub apparatus in claim 1, wherein the gauge is of the type which records various conditions in the well bore, including temperature, pressure, viscosity, and other conditions.

6. The sub apparatus in claim 1, wherein the sub would be dimensioned to be threaded onto various sizes of pipe with various gauges of threads.

7. The sub apparatus in claim 1, wherein the port through the sub wall would comprise at least three ports, equidistant apart, each port allowing fluid contact from fluid outside the sub into the chamber.

8. The sub apparatus in claim 1, further comprising a shock absorbing tip on the lower end of the gauge for resting on a floor of the chamber and absorbing impact when the sub is lowered down the well bore.

9. A sub apparatus for protecting a gauge being delivered down a well bore, comprising:

a. a sub body, having first and second ends threadably attachable to sections of pipe above and below the sub apparatus;

b. a first flow bore through the sub body for allowing fluid within the sections of pipe to flow through the sub body, c. a chamber formed in the sub body which has no fluid contact with the flow bore in the sub body, d. a gauge receivable into the chamber and secured therein;

e. a plurality of ports formed in the wall of the sub body allowing fluid around the outside of the sub body to flow in and out of the chamber so that fluid conditions can be recorded by the gauge.

10. The sub apparatus in claim 9, wherein the gauge includes a cushion on its lower end to rest on a floor of the chamber when the gauge has been threadably secured in the chamber.

11. The sub apparatus in claim 9, wherein the gauge is of the type which records various conditions in the well bore, including temperature, pressure, viscosity, and other conditions.

12. The sub apparatus in claim 9, wherein the sub would be dimensioned to be threaded onto various sizes of pipe with various gauges of threads.

13. The sub apparatus in claim 9, wherein an upper end of the gauge is threadably engageable into the upper end of the chamber for securing the gauge in place in the chamber.

14. The sub apparatus in claim 9, further comprising a flow bore through the sub body for allowing fluid within the sections of pipe to flow through the sub body.

15. A sub apparatus for protecting a gauge being delivered down a well bore, comprising:

a. a sub body, having first and second ends threadably attachable to sections of pipe above and below the sub apparatus;

b. a flow bore through the sub body for allowing fluid within the sections of pipe to flow through the sub body;

c. a chamber formed in the sub body for receiving a gauge which records conditions within the well bore therein, but has no fluid contact with the flow bore through the sub body; and d. a plurality of ports formed in the wall of the sub body allowing fluid around the outside of the sub body to flow in and out of the chamber so that fluid conditions can be recorded by the gauge.

* * * * *